US007681287B2

(12) United States Patent
Iten

(10) Patent No.: US 7,681,287 B2
(45) Date of Patent: Mar. 23, 2010

(54) CUFFLINK

(75) Inventor: Roland Iten, Lausanne (CH)

(73) Assignee: X-Ray Management & Licensing Ltd. (GB)

( * ) Notice: Subject to any disclaimer, the term of this patent is extended or adjusted under 35 U.S.C. 154(b) by 0 days.

(21) Appl. No.: 11/817,265

(22) PCT Filed: Feb. 28, 2006

(86) PCT No.: PCT/IB2006/000399

§ 371 (c)(1),
(2), (4) Date: Aug. 28, 2007

(87) PCT Pub. No.: WO2006/111800

PCT Pub. Date: Oct. 26, 2006

(65) Prior Publication Data

US 2008/0189914 A1 Aug. 14, 2008

(30) Foreign Application Priority Data

Feb. 28, 2005 (EP) ..... 05101513

(51) Int. Cl.
*A44B 5/00* (2006.01)

(52) U.S. Cl. ..... 24/102 R; 24/97; 24/102 PL

(58) Field of Classification Search ..... 24/97–100.5, 24/102 PL, 102 E, 102 SL, 102 FC, 41.1, 24/102 R, 578.11
See application file for complete search history.

(56) References Cited

U.S. PATENT DOCUMENTS 96,808 A * 11/1869 Horack ..... 24/98
422,890 A * 3/1890 Peck ..... 24/98
2,209,148 A 7/1940 Bezault
D479,488 S 9/2003 Stewart-Stand

FOREIGN PATENT DOCUMENTS

| | | |
|---|---|---|
| DE | 9 886 | 7/1880 |
| DE | 148 521 | 2/1904 |
| DE | 22 30 197 | 1/1974 |
| FR | 942 631 | 2/1949 |

OTHER PUBLICATIONS

International Search Report dated Oct. 6, 2006 for International Application No. PCT/IB2006/000399.
International Preliminary Report on Patentability issued on Sep. 12, 2007 for International Application No. PCT/IB2006/000399.

* cited by examiner

*Primary Examiner*—James R Brittain
(74) *Attorney, Agent, or Firm*—Galbreath Law Office, P.C.; John A. Galbreath

(57) ABSTRACT

Cufflink comprising an elongated central part (1), adapted for being inserted in a cuff-hole, a first end part (2) extending from a first extremity of said central part (1) in a direction transverse to the longitudinal axis of said central part (1), and a second end part (3) extending from a second extremity of said central part (1) in a direction transverse to the longitudinal axis of said central part (1). At least one of said first and second end parts (2, 3) comprises a mobile locking element (20, 30, 23, 33) connected to it, and having an extended locked position and a retracted unlocked position, said locking element (20, 30, 23, 33) protruding or rotating from said end part (2, 3) beyond the corresponding extremity of said central part (1) in the locked position.

2 Claims, 3 Drawing Sheets

CUFFLINK

The present invention relates to a cufflink comprising an elongated central part and two end parts, at least one end part having a mobile locking element.

Cufflinks have already been described in different publications. US D479,488 discloses an ornamental design for a cufflink which comprises an elongated part rotatably connected to both ends of a central part. Said central part is intended to be inserted in a cuff-hole while the elongated parts are rotated 90 degrees to hold the cuff.

A major drawback of this invention resides in the fact that the cufflink is difficult to put on and to remove. It is may also be difficult to attach without using both hands.

The aim of the present invention is to propose a cufflink which is easy to put on and to remove.

This aim is achieved by a cufflink as described herein. Said cufflink comprises an elongated central part adapted for being inserted in a cuff-hole. It further comprises a first end part extending from a first extremity of said central part in a direction transverse to the longitudinal axis of said central part and a second end part extending from a second extremity of said central part in a direction transverse to the longitudinal axis of said central part. At least one of said first and second end parts comprises a mobile locking element connected to it, and having an extended locked position and a retracted unlocked position. Said locking element protrudes or rotates from said end part beyond the corresponding extremity of said central part in the locked position.

The invention will be better understood thanks to the following detailed description of preferred embodiments with reference to the attached drawings, in which.

According to a preferred embodiment shown by FIGS. 1 to 4, the cufflink of the invention comprises a preferably elongated central part (1) adapted to be inserted in a cuff-hole. Each end of the central part (1) comprises a preferably elongated first end part (2) and a preferably elongated second end part (3). Said parts (2, 3) extend respectively from a first and a second extremity of the central part (1) in a direction transverse to the longitudinal axis of said central part (1).

The end parts (2, 3) extend in opposite directions from their respective end of the central part (1) as to form with said central part (1) a Z-shape.

Figure 1:
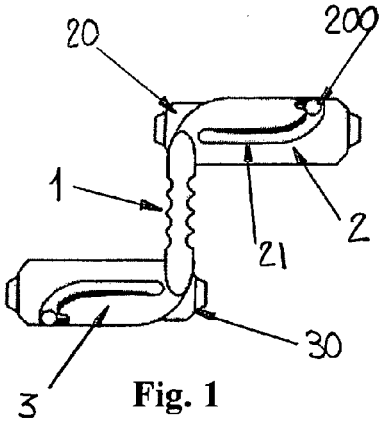
FIG. 1 represents a front view of the cufflink according to a first embodiment of the present invention, when both mobile locking elements are in their retracted position in an unlocked position.
Figure 2:
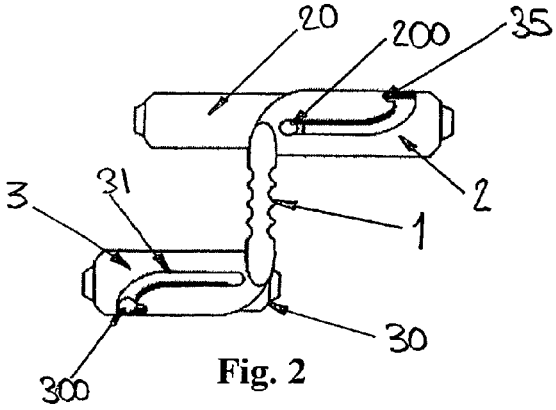
FIG. 2 represents a front view of FIG. 1, when one mobile locking element is in its extended position.
Figure 3:
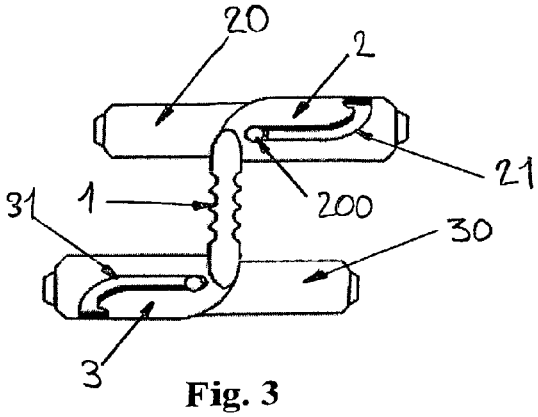
FIG. 3 represents a front view of the first embodiment of the present invention when both mobile locking elements are in their extended position in a locked position.
Figure 4:
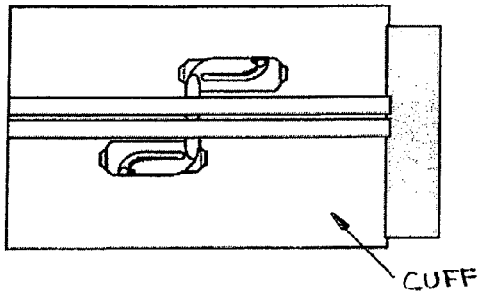
FIG. 4 and FIG. 5 represents a front view of the said cufflink after having been inserted in the cuff-hole, said cufflink being respectively in their retracted and extended position.
Figure 5:
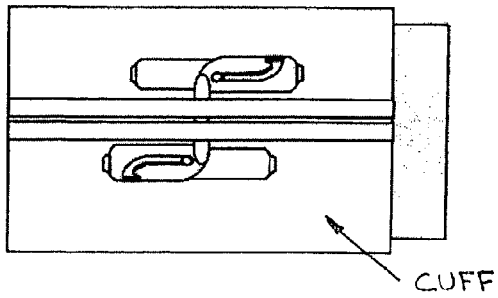

As shown by FIGS. 1 to 3, each end part (2, 3) comprises a mobile locking element (20, 30) which is in a retracted position inside said end parts (2, 3) while the cufflink is in an unlocked position. The locking elements (20, 30) protrude from said end parts (2, 3) beyond the corresponding extremity of the central part (1) when the cufflink is in a locked position, to form with said central part (1) a H-shape.

The locking element (20, 30) is mounted inside a housing (not shown) located in the ends part (2, 3) of the cufflink. Said locking element (20, 30) is actuated by the force of a spring (not shown) which is positioned inside said housing so that its elastic force urges the locking element (20, 30) to its extended position. The locking element (20, 30) comprises a pin (200, 300) extending through a groove (21, 31) in the end part (2, 3) for controlling the movement of the locking element (20, 30) and limiting the amplitude of said movement.

A part of the groove (21, 31) has a hook shaped recess (35) into which said pin (200, 300) can be positioned in order to maintain the locking element (20, 30) in a retracted position.

The cufflink can thus be locked by pushing on the locking element (20, 30) to release the pin (200, 300) from said recess (35) and allow the locking element to slide along the groove (21, 31). The spring (not shown) pushes the locking element (20, 30) out of the end parts (2, 3) until the pin (200, 300) comes to rest against the end of the groove (21, 31)

The cufflink can be unlocked by pushing on the extremity of the locking element (20, 30) against the force of the spring located inside the end parts (2, 3) until the pin (200, 300) is engaged into said recess (35) of the groove (21, 31)

For inserting the cufflink of the invention in a cuff-hole, at least one end part (2, 3) is placed in its unlocked position. The end part is inserted in the cuff-hole, until the central part (1) rests against the cuff. The cufflink is then slightly turned and pushed further through the cuff-hole, until the central part (1) is correctly inserted in the cuff-hole. The locking element (20, 30) is pressed to lock the cufflink.

In a variant of this embodiment, only one end part (2, 3) of the cufflink comprises a locking element (20, 30).

Figure 6:
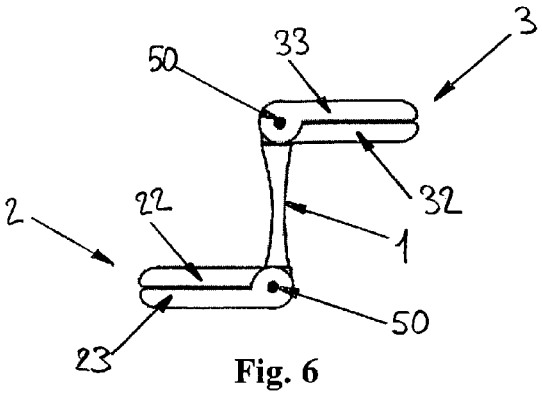
FIG. 6 represents a front view of the cufflink according to a second embodiment of the present invention when both mobile elements are in their retracted position in an unlocked position.
Figure 7:
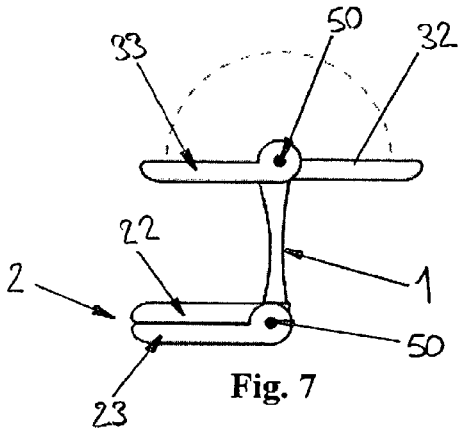
FIG. 7 represents a front view of the cufflink according to the second embodiment of the invention when one mobile locking element is in its extended position.
Figure 8:
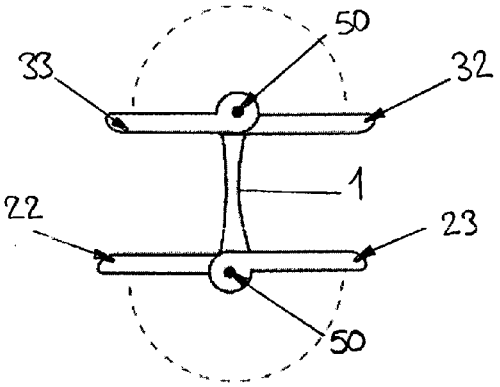
FIG. 8 represents a front view of the cufflink when both mobile locking elements are in their extended position in a locked position.

In a second embodiment of the present invention as shown by FIG. 6 to 8, each end part (2, 3) of the cufflink is made up of a fixed element (22, 32) and a mobile locking element (23, 33). Said fixed element (22, 32) is fixedly connected to the central part (1) and extends respectively from a first and a second extremity of the central part (1) in a direction transverse to the longitudinal axis of said central part (1). Said fixed elements (22, 32) are arranged to form a Z-shape with the central part (1).

The mobile locking element (23, 33) is rotatably connected to the central part (1) as to rest on top of said fixed element (22, 32) in an unlocked position. Said locking element (23, 33) is rotated around a rotation axis (50) such that it can be extended on the other side of the corresponding extremity of the central part (1) in order to lock the cufflink.

Figure 12:
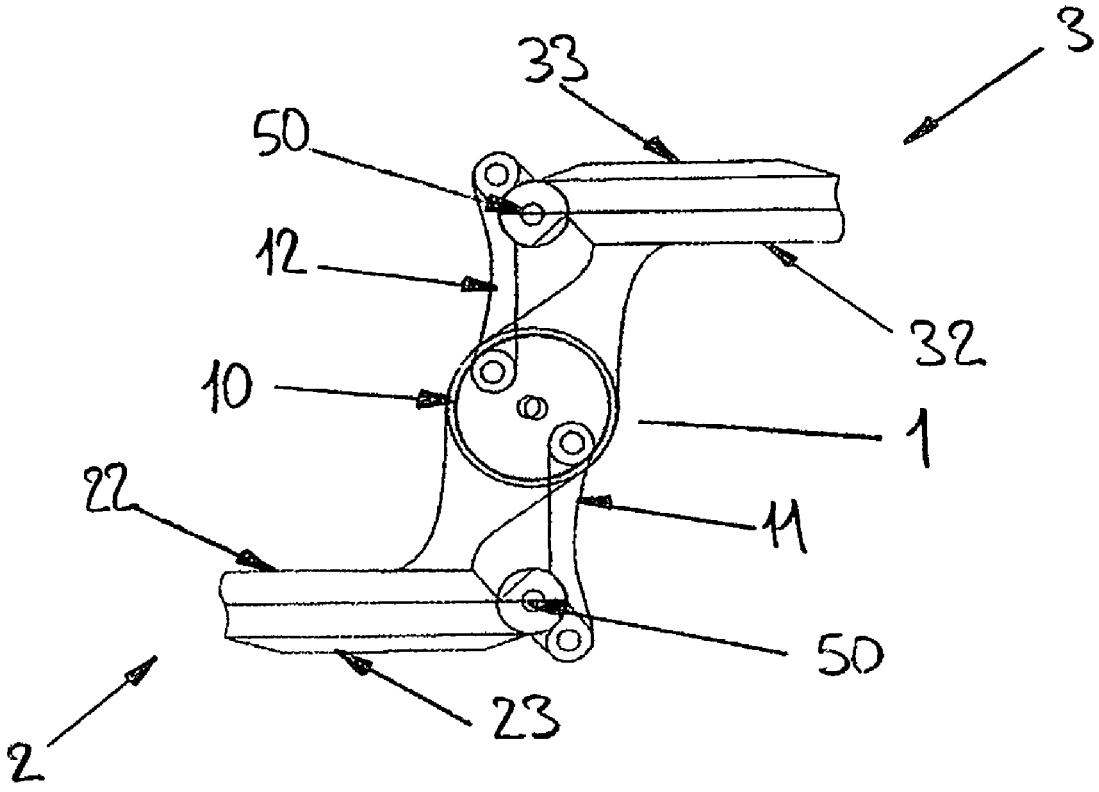
FIG. 12 represents a front view of the cufflink in a variant of the second embodiment of the invention.

In a variant of the second embodiment, the cufflink further comprises a transmission mechanism (10, 12, 13) for connecting both locking elements (23, 33) such that when one of said locking element (23, 33) is rotated, the other one is also moved to be brought in the same position (FIG. 12). Both locking elements (23, 33) can thus be locked or unlocked by one actuation only, and from one side only of the cufflink, thus making the use of the cufflink significantly easier.

Figure 9:
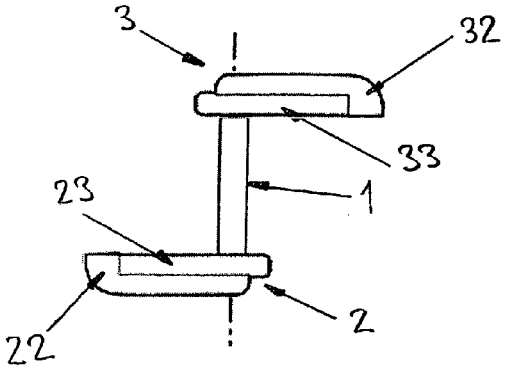
FIG. 9 represents a front view of the cufflink according to a third embodiment of the present invention when both mobile locking elements are in their retracted position in an unlocked position.
Figure 10:
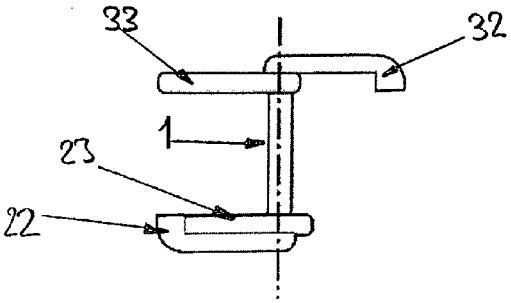
FIG. 10 represents a front view of the cufflink according to the third embodiment of the invention when one mobile locking element is in its extended position.
Figure 11:
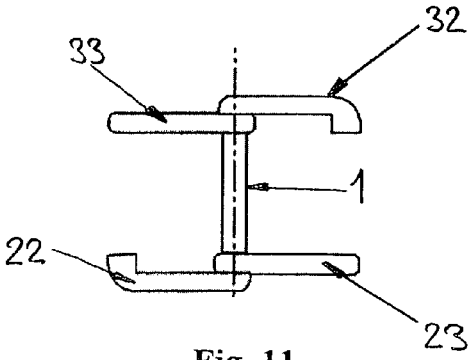
FIG. 11 represents a front view of the cufflink when both mobile locking elements are in their extended position in a locked position.

According to another variant of the second embodiment of the present invention, the rotation axis of the locking element (23, 33) corresponds to the longitudinal axis of the central part (1) of the cufflink as shown by FIGS. 9 to 11.

Although the present invention has been described with reference to specific embodiments, this description is not meant to be construed in limiting sense. Various other modifications of the invention can be contemplated without departing from the scope of the invention as defined in the appended claims.

The invention claimed is:

1. Cufflink comprising an elongated central part, adapted for being inserted in a cuff-hole, a first end part extending from a first extremity of said central part in a direction transverse to the longitudinal axis of said central part, a second end part extending from a second extremity of said central part in a direction transverse to the longitudinal axis of said central part, wherein said first and second end parts both comprise mobile locking elements connected to them, such that each said locking element is arranged to be capable of protruding from said respective end part from a retracted unlocked position to an extended locked position along the longitudinal axis of said respective end part, and wherein each of the said locking elements comprises a pin extending through a groove in the respective end part, said groove being adapted to control and limit the amplitude of movements of the locking element, each said locking element being actuable by a spring located inside the respective end part.

2. Cufflink according to claim 1, wherein each said groove comprises a hook for holding the pin connected to the respective locking element, thus maintaining said locking element in its retracted position.

* * * * *